US007146986B2

(12) United States Patent
Ide

(10) Patent No.: US 7,146,986 B2
(45) Date of Patent: Dec. 12, 2006

(54) METHOD FOR FORMING AN ARTIFICIAL FINGERNAIL ON A NATURAL FINGERNAIL

(75) Inventor: Akinori Ide, Tokyo (JP)

(73) Assignee: P. Shine Co., Ltd., Tokyo (JP)

( * ) Notice: Subject to any disclaimer, the term of this patent is extended or adjusted under 35 U.S.C. 154(b) by 170 days.

(21) Appl. No.: 10/898,085

(22) Filed: Jul. 22, 2004

(65) Prior Publication Data

US 2006/0016455 A1 Jan. 26, 2006

(51) Int. Cl.
*A45D 7/00* (2006.01)

(52) U.S. Cl. ..... 132/200

(58) Field of Classification Search ..... 132/200, 132/73; 156/307.3, 307.7, 344, 325
See application file for complete search history.

(56) References Cited

U.S. PATENT DOCUMENTS

| | | | | |
|---|---|---|---|---|
| 2,162,155 | A * | 6/1939 | Calvin | 132/73 |
| 2,288,386 | A * | 6/1942 | Belden | 132/73 |
| 3,231,533 | A * | 1/1966 | Garrett et al. | 162/135 |
| 3,277,900 | A * | 10/1966 | Lappe | 132/73 |
| 3,484,338 | A * | 12/1969 | Britton | 428/462 |
| 4,450,848 | A | 5/1984 | Ferrigno | |
| 4,860,774 | A * | 8/1989 | Becker | 132/200 |
| 5,513,664 | A * | 5/1996 | Krupsky | 132/200 |
| 5,806,536 | A | 9/1998 | Tietjen | |
| 5,921,250 | A | 7/1999 | Rhea et al. | |
| 6,060,073 | A * | 5/2000 | Keller | 424/401 |
| 6,367,485 | B1 | 4/2002 | Dotton-Davis et al. | |
| 6,536,444 | B1 * | 3/2003 | Chung | 132/200 |

FOREIGN PATENT DOCUMENTS

| | | | |
|---|---|---|---|
| GB | 2340392 | * | 2/2000 |
| JP | 2001-353021 | | 12/2001 |

* cited by examiner

*Primary Examiner*—Todd E. Manahan
*Assistant Examiner*—Rachel A. Running
(74) *Attorney, Agent, or Firm*—Bachman & LaPointe, P.C.

(57) ABSTRACT

A method for forming an artificial fingernail on a natural fingernail comprises the steps of preparing a water-soluble polyvinyl alcohol solution; applying the solution on natural fingernail 2 to form an adhesive layer 3 thereon; putting artificial fingernail 4 on natural fingernail 2 through adhesive layer 3; and curing adhesive layer 3. Although fully cured, adhesive layer 3 can be dissolved and softened in water so that artificial fingernail 4 can easily be removed from natural fingernail 2 in a short time.

3 Claims, 1 Drawing Sheet

METHOD FOR FORMING AN ARTIFICIAL FINGERNAIL ON A NATURAL FINGERNAIL

TECHNICAL FIELD

This invention relates to a method for removably forming an artificial fingernail on a natural fingernail.

BACKGROUND OF THE INVENTION

For example, U.S. Pat. No. 4,450,848 to Elisa L. Ferrigno issued on May 29, 1984 exhibits an artificial fingernail forming method utilizing a conventional acetate plastic tip glued on with Krazy Glue™ on the free end of a natural fingernail. A thin coating of Krazy Glue™ is applied to a top surface of natural fingernail rearward of the tip by a wooden stick. Before the thin coating is allowed to dry, a layer of Mona™ Superfine Clear Powder is applied to the coating to a thickness slightly greater than that of the tip. Upon drying, the top surface thereof is optionally buffed with a fine sandpaper. Thereafter a second thin coating of Krazy Glue™ is applied to the surface of the polymer layer and allowed to dry. After drying, the surface is again buffed until smooth and flush with the surface of the tip. Thereafter, nailpolish is applied to the top surface of the entire artificial fingernail. The fingernail remains in place without lifting off for approximately eight weeks.

Krazy Glue™ comprises an instantaneous adhesive that comprises toxic cyanoacrylate because it produces formaldehyde by hydrolysis of cured polymer. Accordingly, cyanoacrylate is injurious to a living body and a wearer must avoid using it for long period of time or in a larger amount. Also, cyanoacrylate is smelly and represents the strong adhesive property, and therefore, smelly acetone must be used to dissolve cyanoacrylate when the artificial fingernail is removed from the natural nail.

Japanese Patent Disclosure No. 2001-353021 to K. Hanaoka published Dec. 25, 2001 discloses a method for forming an artificial fingernail with a forming set that comprises an extension or substrate for attachment to a natural nail, an adhesive for adhering the substrate to the natural nail, acrylic resin powder used as acrylic resin layer adhered on the substrate with an adhesive, and a file for polishing a surface of the substrate to a final shape. In this reference, the substrate and acrylic resin powder layer are attached in turn on the natural nail to form a bonded integral nail structure of the substrate and acrylic resin layer, and thereby make the artificial nail into a desirable shape via relatively easy processes during a short period of time at inexpensive cost.

U.S. Pat. No. 5,806,536 to Marlene Tietjen issued on Sep. 15, 1998 describes an artificial nail removal arrangement that comprises a vessel having a cylindrical wall to contain an abrasive pad of rough fibers and a solvent, and a solvent contained in the vessel. In this patent, a finger or several fingers are inserted into a central hole formed in the abrasive pad to rub an artificial nail attached on a natural nail and scrap the artificial nail in solvent off the natural nail.

U.S. Pat. No. 5,921,250 to Cord L. Rhea et al. issued on Jul. 13, 1999 demonstrates an artificial nail remover container device that comprises a container, a solvent such as acetone contained in the container, an inner chamber filled with hot water for warming the acetone wherein the artificial nail attached on a natural nail is immersed in the heated acetone to remove the artificial one.

Also, U.S. Pat. No. 6,367,485 to Audrey Shelby Dotton-Davis et al. issued on Apr. 9, 2002, exhibits an acrylic fingernail removal strip formed into a generally "H" shape with adhesive on each end of the strip. An absorbent pad element is affixed to the center portion of the strip to allow user to apply acetone onto the absorbent pad when an artificial nail to be removed is wrapped with the removal strip so that the nail is soaked in acetone and the strip retains heat therein to aid the acetone in the removal process.

The foregoing conventional methods for forming artificial fingernails require an expensive set of many materials and utensils to form and remove the artificial fingernails. Also, they need smelly acetone to dissolve cyanoacrylate upon removing the artificial fingernail which is destroyed into the nonreusable shape by acetone upon the removal in most cases. In addition, another problem arises that the difficulty in removing the artificial nail prevents repeated lessons of nail caring methods in beauty schools and beauty salons.

An object of the present invention is to provide a method for forming an artificial fingernail on a natural fingernail in a manner to easily remove the artificial fingernail later without any damage thereof. Another object of the present invention is to provide a method for forming an artificial fingernail on a natural fingernail without utilization of injurious adhesive. Still another object of the present invention is to provide a method for removing an artificial fingernail without smelly acetone. A further object of the present invention is to provide a method for easily forming an artificial fingernail on a natural fingernail and then easily removing the same in water.

SUMMARY OF THE INVENTION

A method for forming an artificial fingernail on a natural fingernail according to the present invention, comprises the steps of preparing a water-soluble adhesive; applying the adhesive on the natural fingernail to form an adhesive layer thereon; putting the artificial fingernail on the natural fingernail through the adhesive layer; and curing the adhesive layer. Although fully cured, the adhesive layer can be softened and weakened when the artificial and natural fingernails are immersed into water because of the water-solubility of the adhesive layer. Accordingly, the artificial fingernail can easily be removed from the natural fingernail in a short time without inflicting any pain to wearer and without damaging the artificial fingernail that is then reusable.

BRIEF DESCRIPTION OF THE DRAWINGS

The above-mentioned and other objects and advantages of the present invention will be apparent from the following description in connection with preferred embodiments shown in the accompanying drawings wherein.

BEST MODE FOR CARRYING OUT THE INVENTION

Figure 1:
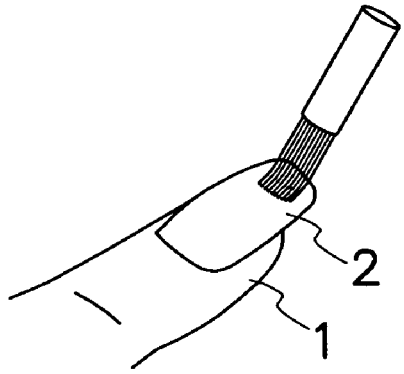
FIG. 1 is a perspective view showing an application of an adhesive on a natural fingernail according to the method of the present invention.
Figure 2:
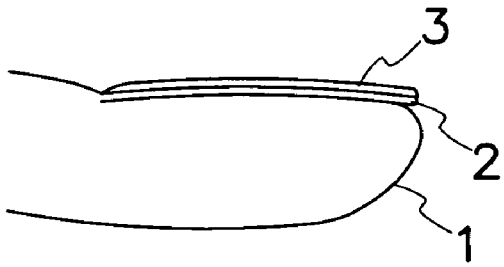
FIG. 2 is a side view showing an adhesive layer formed on a natural fingernail.
Figure 3:
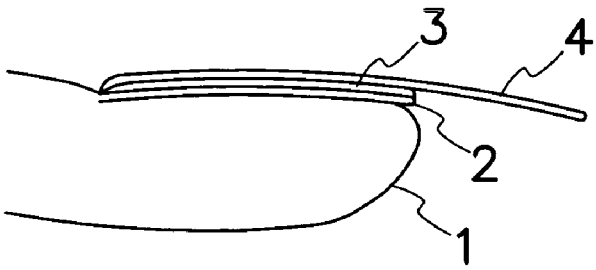
FIG. 3 is a side view showing an artificial fingernail bonded on the natural fingernail through the adhesive layer.

The method according to the present invention is described herein after in connection with FIGS. 1 to 3 of the drawings.

To form an artificial fingernail on a natural fingernail according to the present invention, water-soluble powdery adhesive is added little by little in water at a room temperature with agitation to fully disperse the adhesive in the water. A typical water-soluble adhesive is preferably powdery polyvinyl alcohol with the low or middle polymerization degree of 200 to 1600 and partial saponification of 70 to 98 mole %. Polyvinyl alcohol of the polymerization degree over 1600 has a stronger adhesive property and less water-solubility so that artificial fingernail cannot be easily removed because the adhesive layer can hardly be dissolved in water. Polyvinyl alcohol of the low polymerization degree less than 200 shows less bonding force so that artificial fingernail cannot be firmly glued on natural fingernail for a long period of time. Accordingly, polymerization degree of polyvinyl alcohol should be between 200 to 1600, preferably 800 to 1500, more preferably 900 to 1400. Also, adhesive property is too strong when polyvinyl alcohol of the partial saponification is over 98 mol %, and it can hardly be dissolved in water at a room temperature because of the reduced resoluble property. Adversely, with the partial saponification under 80 mol %, polyvinyl alcohol comes to poor solubility in hot water, but is soluble in cold water. With the partial saponification less than 70 mol %, polyvinyl alcohol loses the necessary bonding strength.

Resultant aqueous dispersion solution is then kept at a temperature of 80 to 90° C. with agitation for 30 to 60 minutes, and subsequently water and ethanol are mixed in the dispersion solution for dilution to prepare a water-soluble volatile adhesive. Then, as shown in FIG. 1, the adhesive is applied on a natural nail 2 of finger 1 with a brush 5 to form an adhesive layer 3 thereon as shown in FIG. 2. Subsequently, an artificial fingernail 4 is directly put and bonded on natural fingernail 2 through adhesive layer 3 utilizing the adhesive property of adhesive layer 3. Adhesive layer 3 is cured by dehydration or drying to have sufficient bonding force between artificial fingernail 4 and natural nail 2.

Otherwise, additionally artificial fingernail 4 may have an adhesive bottom surface. In lieu of attachment of preformed artificial fingernail 4 on natural nail 2, a new artificial fingernail may be formed on natural nail 2. In this case, a part of a viscous mixture made by blending coloring powder and liquid glue, is placed on cured or uncured adhesive layer 3 to form the mixture into a synthetic resin fingernail of desirable shape by curing of the mixture on cured adhesive layer. Coloring power and liquid glue may be respectively acrylic resin and cyanoacrylate. Since the synthetic fingernail can be removed without any damage from natural nail by dissolution of the adhesive layer 3 in water, it can be reused as a preformed artificial fingernail.

As understood from the foregoing, the present invention contemplates utilizing water-soluble adhesive selected from the group consisting of polyvinyl alcohol, isobutene-maleic anhydride copolymer, polyacrylamide, polyethylene oxide, polyvinyl pyrolidone (PVP), vinyl acetate copolymer, acrylic polymer and mixture thereof to firmly make up and easily remove artificial fingernails. These adhesive materials are enumerated as examples and not intended to be exclusive or exhaustive, and any other suitable adhesive materials can be made to form adhesive layer 3.

To remove artificial fingernail 4 from natural nail 2, a tip of finger 1 with artificial fingernail 4 is immersed into water so that adhesive layer 3 is dissolved and softened in water reducing the bonding force. Accordingly, artificial fingernail 4 can be easily peeled off natural nail 2 of wearer's finger in a short time without any damage to artificial fingernail 4 which is therefore reusable.

EXAMPLE I 200 g of EG•40 GOHSENOL® polyvinyl alcohol available from The Nippon Synthetic Chemical Industry Co., Ltd. Osaka, Japan, was mixed in water of 2000 g with agitation and kept stirred and heated for a certain period of time at a given elevated temperature in a predetermined manner to thoroughly dissolve the vinyl resin in water. Then, water of 1000 g and 90% purity ethanol of 793 g (1000 cc) were blended to the aqueous solution to dilute it and prepare a water-soluble volatile adhesive.

EXAMPLE II

Resultant adhesive was applied on a surface of natural nail 2 to form an adhesive layer 3, and then preformed artificial fingernail 4 was attached directly on adhesive layer 3 and glued on natural nail 2 with the sufficient bonding strength of cured adhesive layer 3. After several weeks passed, artificial fingernail 4 was immersed into water and could easily be removed from natural nail 2 because adhesive layer 3 went runny into water and was softened due to the resoluble property thereof.

EXAMPLE III 60 g of EG•40 GOHSENOL® polyvinyl alcohol available from The Nippon Synthetic Chemical Industry Co., Ltd., was mixed in water of 600 g with agitation and kept stirred and heated for a certain period of time at a given elevated temperature in a predetermined manner to fully dissolve the additive in water. Then, water of 300 g and 90% purity ethanol of 238 g (300 cc) were blended to the aqueous solution to dilute it and prepare a water-soluble volatile adhesive. In a similar method to EXAMPLE II, an adhesive layer 3 was formed on a surface of natural nail 2, and then artificial fingernail 4 was stuck on adhesive layer 3 to glue artificial fingernail 4 on natural nail 2 with the sufficient adhesion of cured adhesive layer 3. Several weeks later, artificial fingernail 4 was soaked in water to soften adhesive layer 3 so that artificial fingernail 4 could easily be detached from natural nail 2.

EXAMPLE IV

A water-soluble volatile adhesive was prepared in a similar manner to EXAMPLE I. Obtained adhesive was applied on a surface of natural nail 2 to form an adhesive layer 3, and then a new artificial fingernail was formed by placing a viscous mixture of coloring powder and liquid glue on coagulated adhesive layer 3, forming the mixture into a synthetic resin fingernail of desirable shape and curing formed resinous fingernail. In this case, it has been found that adhesive layer 3 exhibits the sufficient bonding strength between artificial and natural fingernails. After several weeks passed, artificial fingernail was plunged in water and could easily be removed from natural nail 2 because adhesive layer 3 got wet into weakened adhesion. Thus, it also has been found that the water-soluble adhesive may preferably be diluted with water of weight from five to twenty times of the adhesive weight and/or with water of weight two to eight times in addition of ethanol of weight two to six times of the adhesive weight.

What is claimed is:

1. A method for forming an artificial fingernail on a natural fingernail, comprising the steps of:

blending polyvinyl alcohol as a water-soluble glue component and ethanol with water to prepare a water-soluble adhesive which comprises polyvinyl alcohol with the low or middle polymerization degree of 200 to 1600 and partial saponification of 70 to 98 mole %;

applying the adhesive on the natural fingernail to form an adhesive layer thereon;

preparing a mixture of resin powder and liquid glue;

placing the mixture on the cured or uncured adhesive layer;

forming the mixture into an artificial fingernail of desirable shape; and curing the mixture on the cured adhesive layer to adhere the artificial fingernail on the natural nail through the water-soluble adhesive.

2. The method of claim 1, wherein the process for preparing the water-soluble adhesive comprises: adding powdery polyvinyl alcohol little by little in water at a room temperature with agitation to fully disperse polyvinyl alcohol in the water;

keeping the resultant aqueous dispersion solution at a temperature of 80 to 90° C. with agitation; and further adding water and ethanol in the dispersion solution.

3. The method of claim 1, wherein the process for preparing the adhesive comprises: dispersing the water-soluble adhesive in water which has the weight from five to twenty times of that of said adhesive; and further adding water of two to eight times and ethanol of two to six times of the adhesive by weight.

* * * * *